United States Patent [19]

Beckim

[11] 4,433,623

[45] Feb. 28, 1984

[54] APPARATUS FOR AND METHOD OF APPLYING A PATTERN UPON A SUBSTRATE

[75] Inventor: Kenneth A. Beckim, Oshawa, Canada

[73] Assignee: PPG Industries, Inc., Pittsburgh, Pa.

[21] Appl. No.: 326,097

[22] Filed: Nov. 30, 1981

[51] Int. Cl.[3] ..... B41L 41/00; B41F 35/00

[52] U.S. Cl. ..... 101/123; 15/306 B; 101/129; 101/425

[58] Field of Search ..... 101/425, 119, 120, 123, 101/129; 15/357, 306 B

[56] References Cited

U.S. PATENT DOCUMENTS

| | | | |
|---|---|---|---|
| 932,600 | 8/1909 | Burdick | 101/119 |
| 2,371,930 | 3/1945 | Sonnino | 101/123 |
| 2,526,419 | 10/1950 | Reeves | 15/357 |
| 3,302,564 | 2/1967 | Wilford | 101/123 |
| 3,536,005 | 10/1970 | Derrickson | 101/129 |
| 3,862,469 | 1/1975 | Burgoon | 15/357 |
| 4,193,344 | 3/1980 | Ericsson | 101/129 |
| 4,307,662 | 12/1981 | Mittev | 101/120 |

FOREIGN PATENT DOCUMENTS

| | | | |
|---|---|---|---|
| 815704 | 7/1959 | United Kingdom | 101/129 |

*Primary Examiner*—Clyde I. Coughenour

*Attorney, Agent, or Firm*—Donald Carl Lepiane; Rita M. Irani

[57] ABSTRACT

Silk-screening apparatus for applying a pattern on a substrate surface includes suction applying facilities for returning residual pattern forming medium back through a screen member to the upper surface thereof after a pattern has been applied. Means are provided for adjusting the magnitude of suction from a minimal value adjacent imperforate portions of the screen member to a substantially constant value adjacent perforated portions sufficient to draw the pattern-forming medium back to the upper surface. Means are provided for maintaining a substantially constant magnitude of suction as a suction applying member passes over perforated portions of the screen member having varying degrees of porosity.

4 Claims, 10 Drawing Figures

APPARATUS FOR AND METHOD OF APPLYING A PATTERN UPON A SUBSTRATE

FIELD OF THE INVENTION

The invention relates to applying a pattern upon a substrate, and more particularly to silk screening a pattern upon a sheet of glass.

DISCUSSION OF THE TECHNICAL PROBLEM

It is known to apply a pattern having a preselected configuration upon a substrate surface by a silk-screening technique, whereby a medium, e.g. ink, paint, etc., is applied to the surface of a screen member having perforated portions defining the desired pattern. Commonly the pattern forming medium is of a viscosity such that it will remain as a layer on the upper surface of the screen member until a squeegee or a functionally similar element is passed over the surface of the screen member to move the pattern forming medium through the perforated portion of the screen member to the adjacent substrate surface to form the desired pattern. After the pattern has been formed, the screen member is commonly displaced to permit the first substrate to be removed and a new one to be substituted in its place, whereupon the process is repeated.

If the ink is moved by a squeegee through the screen member and an area of the perforated portion thereof has no underlying substrate surface upon which to deposit the ink, an accumulation of ink may build up in those areas and drip at disadvantageous times onto portions of the substrate upon which ink is not desired. Such an ink build-up condition is commonly encountered when silk-screening a border pattern on the extreme marginal edges of a substrate where the perforated portions extend beyond the substrate edge or due to imperfect registration between the perforated portions of the screen member and the substrate edge. A need exists for screen member cleaning facilities to minimize this operational difficulty.

U.S. Pat. Nos. 3,731,623 to Bubley et al. and 4,121,519 to Porth each teach screen member cleaning facilities taking the form of scoops mounted above the upper surface of the screen member to remove excess ink therefrom. Although useful for their intended purpose, neither patent teaches facilities for removing excess ink from within the screen member and from the lower surface thereof.

U.S. Pat. No. 3,302,564 to Wilford teaches a stencil printing machine for pile fabric and the like, including in general, a screen member having perforated central portions and imperforate opposite ends. The screen member is positionable over the fabric to be patterned and an ink applicator is reciprocated from a stationary position over one imperforate end across the perforated central portion of the screen member to the opposite imperforate end while applying ink through the screen member onto the fabric. The screen member and applicator are then displaced to allow advancement of the fabric, and the process is repeated in the opposite direction on another portion of the fabric.

To adequately move the coloring medium through the perforated portion of the screen member into the depth of the pile fabric, the applicator of Wilford includes a positively pressurized, central oriented supply chamber, bounded on either lower edge by flexible squeegee elements. Rather than actuate and deactuate the positively pressurized supply chamber when passing from the perforated central portion to the imperforate end portions of the screen member, Wilford teaches that vacuum chambers may be provided on either side of the positively pressurized supply chamber to draw away coloring medium which leaks under the squeegee elements from the supply chamber when the pressurized supply chamber is positioned over the imperforate end portions of the screen member. Thus, while providing facilities for maintaining the upper surface of a screen member in a relatively clean condition, Wilford provides no teachings concerning the removal of excess ink from within the screen member and from the lower surface thereof.

Precision Screen Machines, Inc. of Hawthorne, N.J. markets a cleaning facility for the removal of excess ink from within the screen member and from the lower surface thereof which includes, in general a belt which is mounted on and between rolls and which is passed across the lower surface of the screen member while a cleaning squeegee is passed across the upper surface to force excess ink onto the belt. Such a system, while useful for its intended purposes, is mechanically complex, requires an additional time-consuming operational step, and requires a solvent system for cleaning the belt after each usage. The solvent must be prevented from contaminating the screen member or pattern continuity is detrimentally affected. Thus, a need exists for apparatus for and a method of applying a pattern on a substrate which avoids the above discussed limitations in the art.

SUMMARY OF THE INVENTION

The present invention provides an apparatus for and a method of applying a pattern to a substrate which avoids the limitations previously discussed, by providing improved facilities for cleaning excess coloring medium from within and from the lower surface of a screen member so as to avoid undesirable accumulation and uncontrolled drippage thereof during a pattern-applying campaign.

The invention includes the steps of positioning a first major surface of the screen member, e.g., the bottom surface, having perforated portions corresponding to the desired pattern adjacent a surface of the substrate to be patterned. A pattern-forming medium, e.g. ink, paint, etc., is provided on the opposite major surface, e.g., the upper surface of the screen member, and portions thereof are moved through the perforated portions of the screen member, e.g., by forces exerted by a print squeegee, to form the desired pattern on the substrate. The invention includes the improvement of, after a pattern portion has been formed on the substrate, applying a reverse-biasing force adjacent at least perforated portions of the screen member with a magnitude sufficient to return residual pattern-forming medium back through the perforated portions of the screen member to the upper surface thereof. In this manner an undesirable accumulation of pattern-forming medium may be diminished or eliminated. Preferably the reverse-biasing force is provided in the form of a suction condition adjacent the upper surface of the screen member having a magnitude sufficient to draw the residual pattern forming medium in the perforations or on the lower surface of the screen member back through the perforated portions of the screen member to the upper surface thereof. Preferably the suction is selectively varied as a suction applying member reciprocates across the upper surface of the screen member from a substantially constant positive value as the suction applying member passes over perforated portions of the screen member to a minimal value as the suction applying member passes over imperforate end portions of the screen member. Facilities are also provided for maintaining a substantially constant magnitude of suction as the suction applying member passes over segments of the perforated portion of the screen member having varying degrees of porosity.

DESCRIPTION OF THE INVENTION

Figure 1:
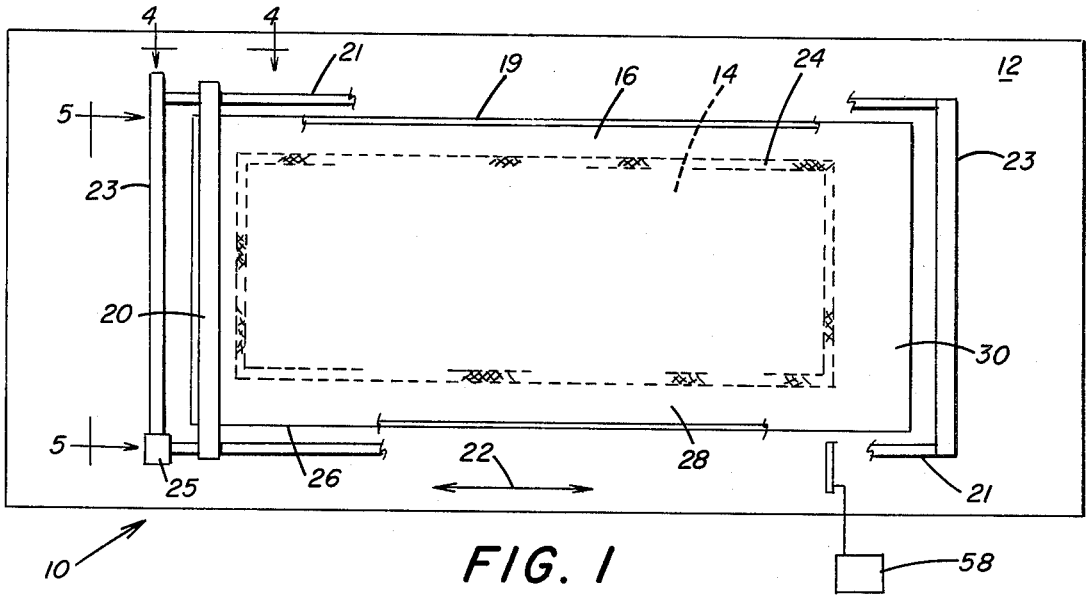
FIG. 1 is a partially schematic plan view of apparatus for silk-screening a pattern onto the surface of a substrate, incorporating features of the present invention.

With reference to FIGS. 1∝3, there is shown a silk screening apparatus 10 including a substrate support table 12; a glass sheet 14 upon which a pattern is to be formed in accordance with the teachings of the invention; a screen member 16 positioned with its lower surface 17 over the glass sheet 14; and a printing head 20 mounted over the upper surface 18 of the screen member 16.

Figure 2:
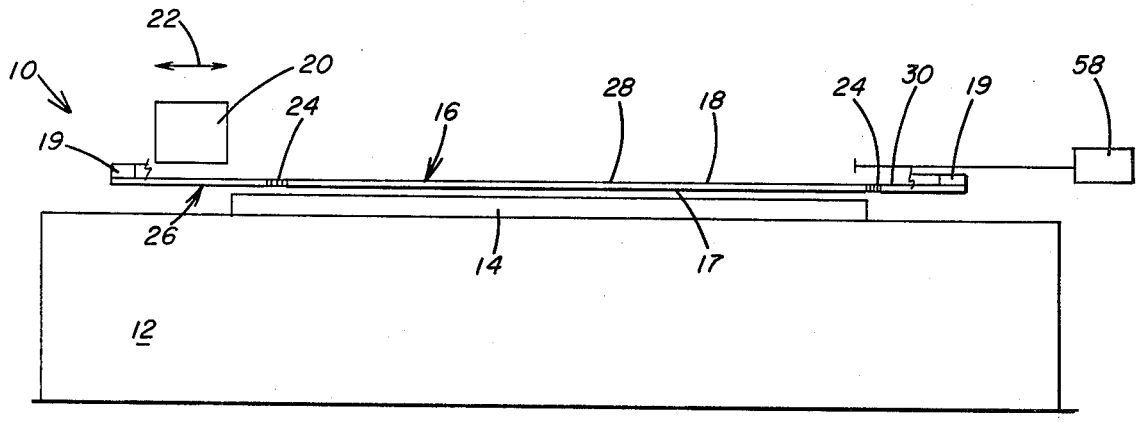
FIG. 2 is an elevated partially schematic side view of the apparatus of FIG. 1 having portions removed for purposes of clarity, showing elements thereof in a printing position.
Figure 3:
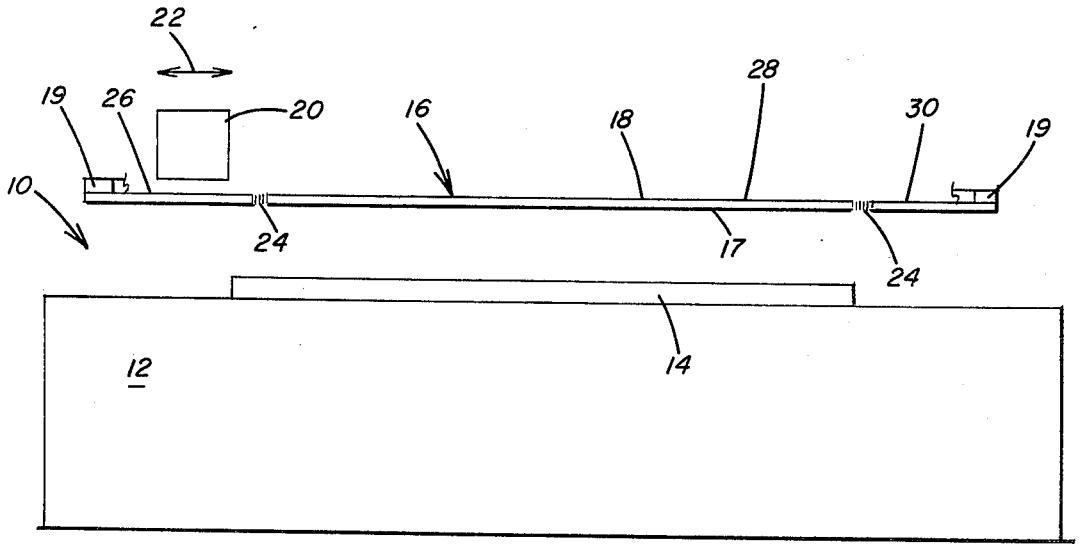
FIG. 3 is a view similar to the view of FIG. 2 showing elements of the apparatus in a substrate loading position.

In the specific embodiment of the invention shown in FIGS. 1–3, the screen member 16 is stretched and mounted upon a frame member 19. The screen member 16 is greater in length and width than the glass sheet 14, and extends beyond the sheet edges. The screen member 16 includes a perforated endless band 24 spaced inward from the frame member 19 which corresponds generally to the marginal edges of the glass sheet 14 when positioned thereover and extends slightly beyond them, to permit the formation of a continuous narrow pattern on the extreme marginal edges of the glass sheet 14. Such a continuous narrow pattern on the extreme marginal edges of a glass sheet may be advantageous in modern automotive glazing applications where an automotive vision panel is mounted substantially flush with the body of the vehicle.

With reference to FIG. 1, the printing head 20 is conveniently mounted on guide rails 21 for reciprocal motion in the direction of arrow 22 between support members 23, driven by drive mechanism 25. As the printing head 20 is advanced along its movement path across the upper surface 18 of the screen member 16, it passes from an initial imperforate end segment 26 to an intermediate at least partially perforated segment 28 (in which the perforated portion 24 is found) to a distal imperforate end segment 30, and is then returned in the reverse direction.

Although not limiting to the invention, in operation a glass sheet 14 is positioned on the substrate support table 12 while the screen member 16 and printing head 20 are in the loading position shown schematically in FIG. 3. Afterwards the screen member 16 and printing head 20 are moved into the printing position shown in FIG. 2. A layer of a pattern-forming medium, e.g. ink or paint, is conveniently provided upon the upper surface 18 of the screen member 16, either before or after the screen member and printing head are moved from the loading position to the printing position. After the printing position is reached, the printing head 20 is advanced across the screen member 16 to bias the pattern forming medium through the perforated endless band 24 to form the desired pattern on the glass sheet 14. Of course, the invention is not limited to the vertical lift mode of operation illustrated in FIGS. 2 and 3, as a clam-shell type lift may also be utilized wherein the screen member 16 is pivoted about bearings at one end of the support table 12 to move between a loading position and a printing position.

Figure 6A:
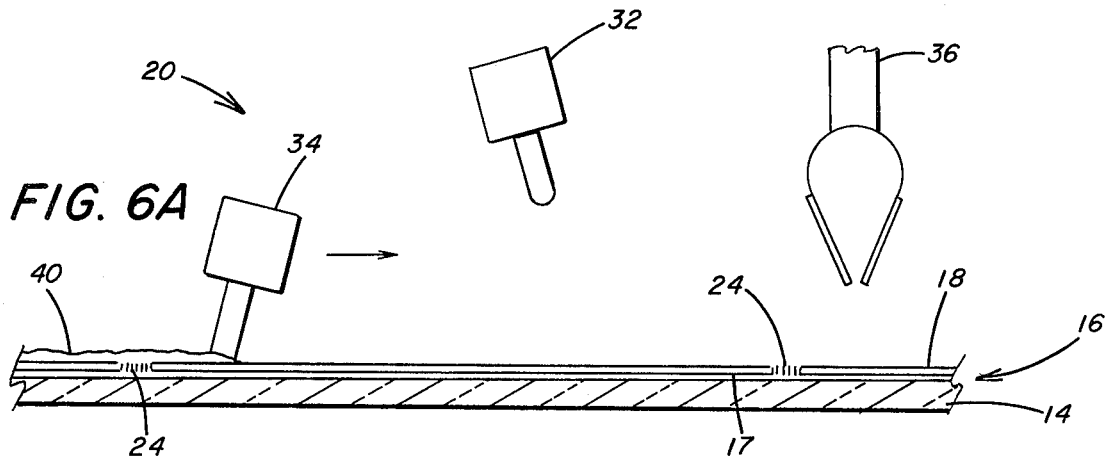
FIGS. 6A, 6B, 6C, and 6D are a series of schematic views illustrating the sequence of operational steps which may be followed in the practice of the present invention.
Figure 6B:
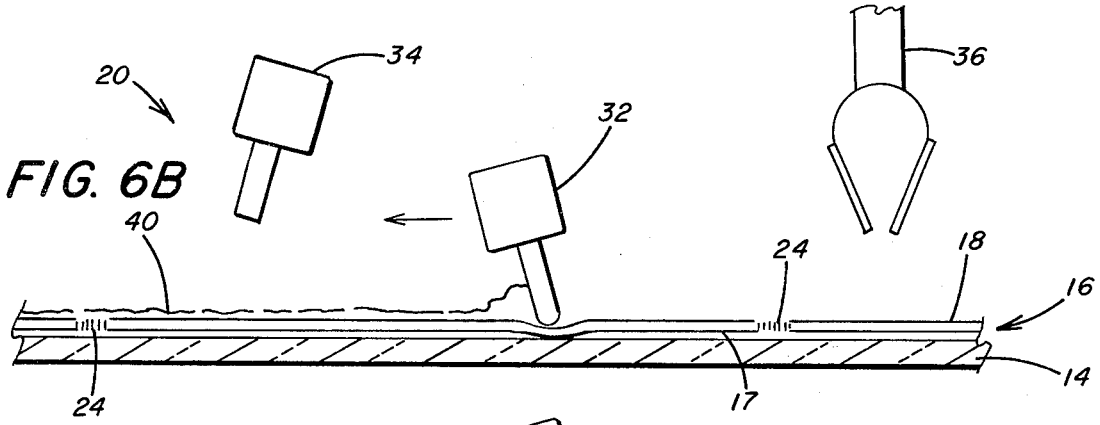

FIGS. 6A and 6B show schematically a representation of the sequence of operational steps performed by the printing head 20 during the silk-screening process described above. In FIG. 6A, the screen member 16 is shown positioned over the substrate 14, and a print squeegee 32, a flood squeegee 34, and a suction head 36 incorporating features of the present invention are positioned above the upper surface 18 of the screen member 16. The printing head 20 (shown schematically in FIGS. 1–3) includes each of the print squeegee 32, flood squeegee 34, and the suction head 36 in the preferred practice of the present invention. As represented by the arrows in FIG. 6A, the printing head 20 is advanced from left to right across the upper surface 18 of the screen member 16 during a flooding step, with the flood squeegee 34 in a lowered or flooding position to deposit a generally uniform layer 40 of a pattern-forming medium onto the upper surface 18 of the screen member 16. As before noted, this initial step in the silk-screening process may occur when the screen member 16 is either in its loading position (FIG. 3) of in its printing position (FIG. 2) but the former is preferred in order to permit a substrate to be loaded into position at the same time the flooding step is occurring. The pattern forming medium is selected to have a viscosity such that it remains on the upper surface 18 of the screen member 16 and does not pass through the perforated endless band 24 thereof unless subjected to an appropriate biasing force.

FIG. 6B shows the printing step wherein the flood squeegee 34 is in an upraised position and the print squeegee 32 is in a lowered or printing position as the printing head 20 moves in an opposite direction across the upper surface 18 of the screen member 16. During this printing step, the screen member 16 is in its printing position (FIG. 2) and preferably is spaced from but in close proximity to the upper surface of the substrate 14, as taught more fully in U.S. Pat. No. 3,731,623 to Bubley et al., which teachings are incorporated herein by reference. The print squeegee 32 engages the upper surface 18 of the screen member 16 and exerts a downward biasing force which forces portions of the layer 40 through the perforated endless band 24 of the screen member 16 to form a desired pattern on the substrate 14.

As before mentioned, an undesirable accumulation of pattern-forming medium may be created within and adjacent the lower surface 17 of the screen member 16 after the print squeegee 32 biases portions of the layer 40 through the perforated portions 24 from the upper surface 18 of the screen member 16. This difficulty is particularly likely to occur during printing to the extreme marginal edges of the substrate 14 or where a misregistration occurs between the substrate 14 and segments of the perforated endless band 24. According to the present invention there is provided facilities for returning residual pattern-forming medium back through the perforated endless band 24 to the upper surface 18 of the screen member 16. For this purpose, a reverse-biasing force is provided and exerted upon the residual pattern-forming medium remaining below the upper surface 18 of the screen member 16 with a magnitude sufficient to overcome its resistance to pass through the perforated endless band 24 to return same to the upper surface 18. Such a reverse-biasing force may be provided by a positive pressure exerted upon the lower surface 17 of the screen member 16, e.g., by the passage of a squeegee across the lower surface 17 or by passing the screen member 16 over a gaseous pressure source, or more preferably as shown in FIGS. 6C and 6D, the reverse-biasing force may be provided by a suction condition generated adjacent the upper surface 18 of the screen member 16.

Figure 6C:
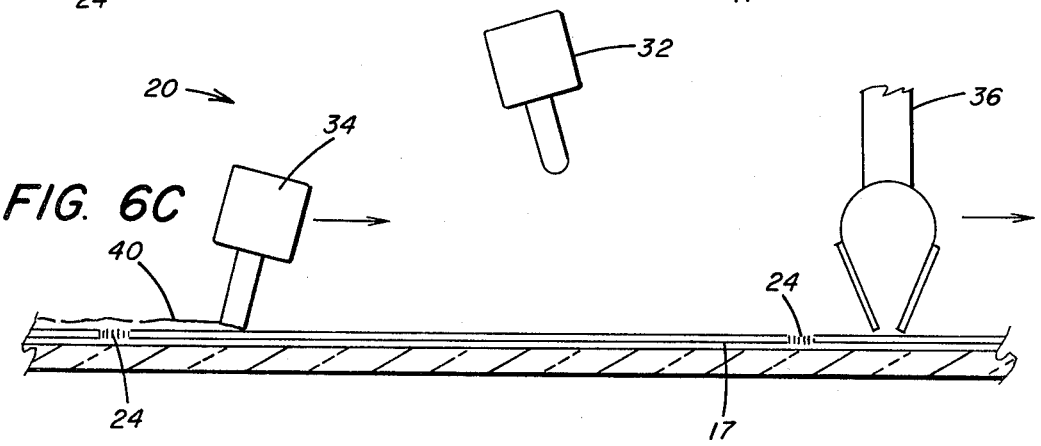

With particular reference to FIG. 6C, there is shown a preferred embodiment of the present invention, wherein a suction head 36, which previously was moving in tandem with the print squeegee 32 and flood squeegee 34 in an upraised position during the flooding step and printing step of FIGS. 6A and 6B, respectively, is moved into a lowered or cleaning position adjacent the upper surface 18 of the screen member 16. As shown in FIG. 6C, the suction head 36 is preferably moved into its cleaning position at the same time that the flood squeegee 34 is flooding the upper surface 18, but is mounted to preceed the floor squeegee 34 across the upper surface 18. The suction head 36 is thus moved into its cleaning position after the print squeegee 32 has forced portions of the layer 40 through the perforated portions 24, so as to withdraw residual pattern forming medium back through the perforated portions 24 to the upper surface 18 of the screen member, prior to the arrival of the flood squeegee 34 on its next flooding step. Thus, in the embodiment of the invention shown in FIG. 6C, the cleaning step occurs as the flooding step occurs, which, as previously mentioned, may be when the screen member is in the loading position (FIG. 3) or in the printing position (FIG. 2).

Figure 6D:
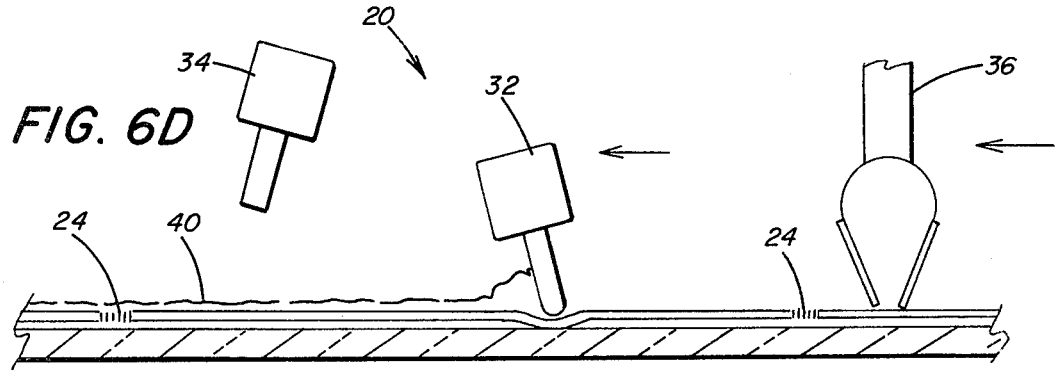

FIG. 6D shows an alternative embodiment of the invention in which the suction head 36 is moved into its cleaning position at the same time that the print squeegee 32 is accomplishing the printing step, but is mounted to follow the progress of the print squeegee 32 across the upper surface 18 of the screen member 16. In this embodiment of the invention, the suction head 36 is moved into its cleaning position when the screen member 16 is in its printing position (FIG. 2).

Figure 4:
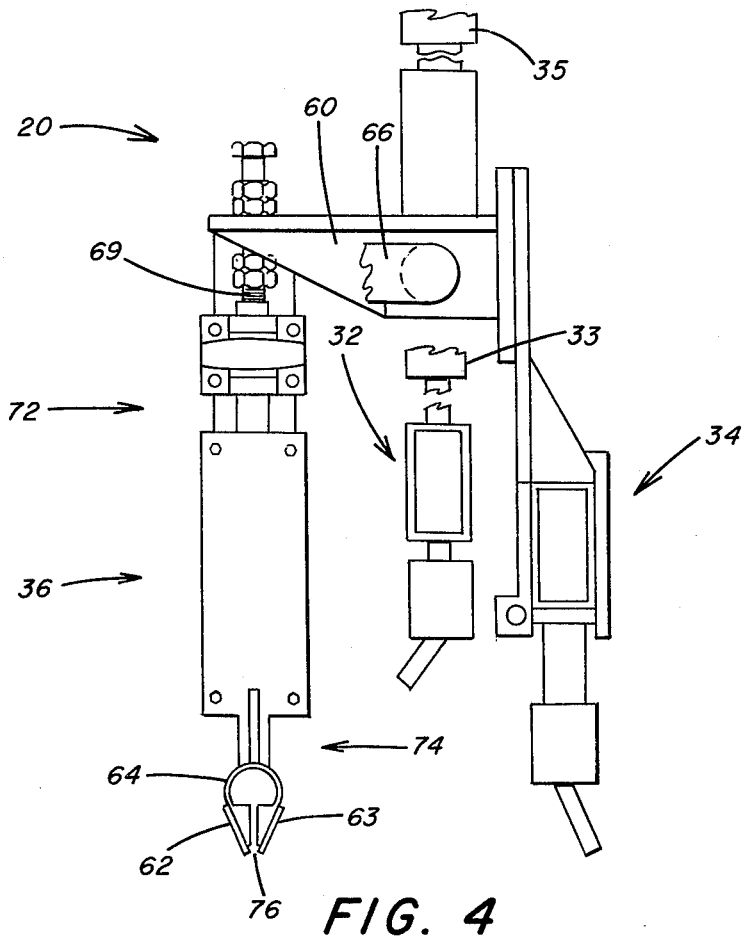
FIG. 4 is a view taken along line 4—4 of FIG. 1, showing the relative orientation of the flooding, printing, and cleaning elements of the present invention, with portions removed for purposes of clarity.

FIG. 4 shows an elevated side view of the printing head 20, including the suction head 36, the print squeegee 32, and the flood squeegee 34. The details of construction of the print squeegee 32 and the flood squeegee 34 are not limiting to the present invention, and may take the form of any squeegee conventionally available in the art. The relative up and down motion of the print squeegee 32 and the flood squeegee 34 may be conveniently provided by air cylinders 33 and 35, respectively, or alternatively may be provided through the use of a chain driven pivot mechanism. As viewed in FIG. 4, the printing head 20 is oriented such that the flood squeegee 34 will be moved into its flooding position as the printing head 20 moves from right to left, and the print squeegee 32 will be moved into its printing position as the printing head 20 moves from left to right. Accordingly, the suction head 36 is preferably mounted by a mounting bracket 60 to the left of both the print squeegee 32 and the flood squeegee 34 in order that it might precede the flood squeegee 34 if the present invention is practiced in the manner illustrated in FIG. 6C, and likewise might follow the print squeegee 32 if the present invention is practiced in the manner shown in FIG. 6D.

Figure 5:
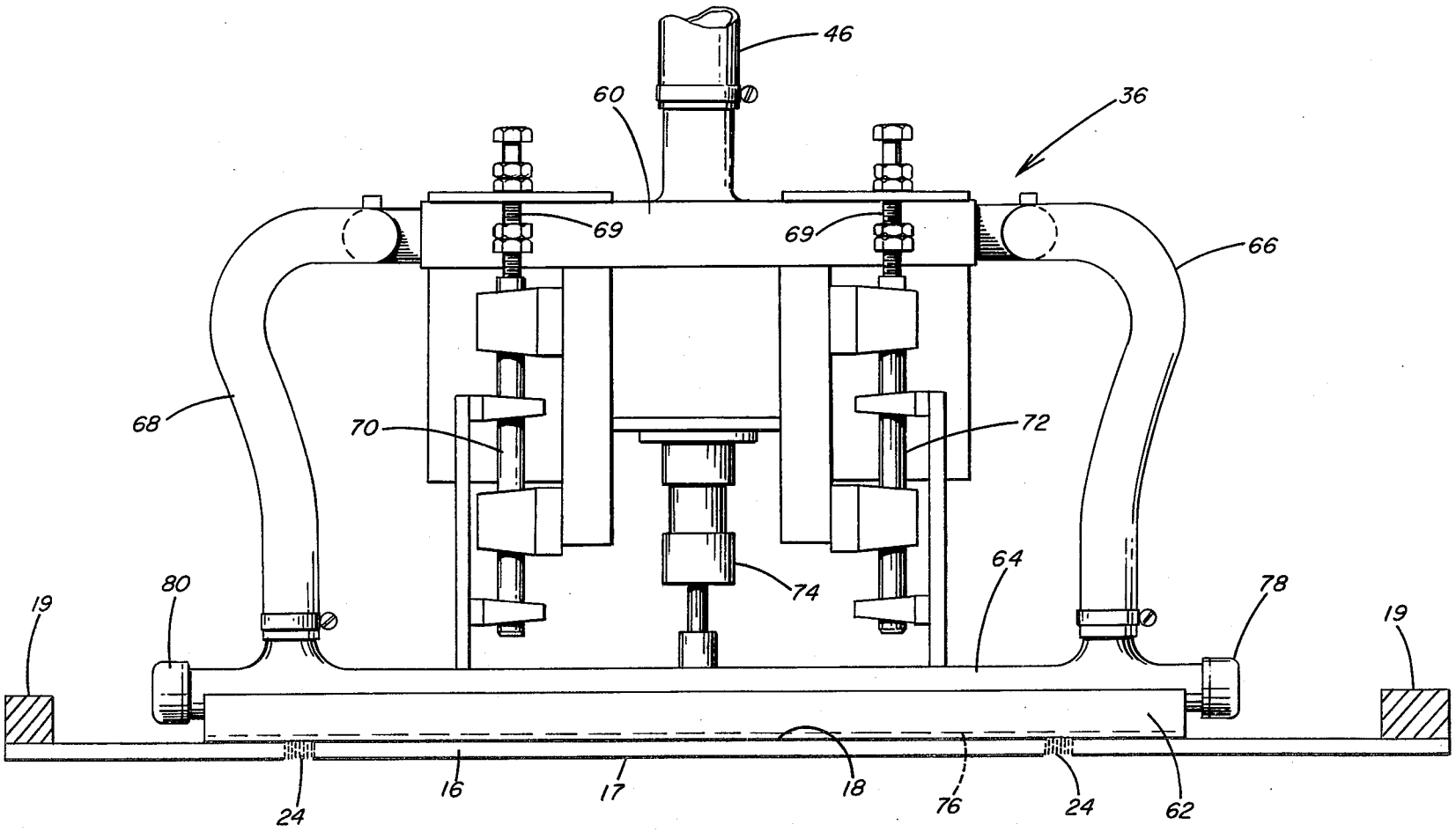
FIG. 5 is a view taken along line 5—5 of FIG. 1, showing details of the cleaning element incorporating features of the present invention, having portions removed for purposes of clarity.

With reference to FIGS. 4 and 5, the suction head 36 preferably utilized in the practice of the present invention, although not limiting thereto, includes a pair of elongated stainless steel blades 62 and 63 angularly mounted in relation to one another to an elongated cylindrical suction chamber 64. The suction chamber 64 conveniently communicates with the suction applying line 46 (shown in FIG. 5) through a pair of hoses 66 and 68 (shown only in FIG. 5). The suction chamber is movably mounted to the mounting bracket 60 by a pair of bolt and locknut assemblies 69 and a pair of Thompson shafts 70 and 72, which guide, stabilize and limit the extent of up and down movement of the suction chamber 64, which is generated by an air cylinder 74 located centrally therebetween. The air cylinder 74 is actuated to lower the suction chamber 64 into the cleaning position in lightly biased engagement with the upper surface 18 of the screen member, such that the stainless steel blades 62 and 64 form a narrow suction slot 76 through which the suction is drawn as the suction head 36 is advanced across the screen member 16. Residual pattern forming medium may be drawn into the suction chamber 64 during operation, and caps 78 and 80 (shown only in FIG. 5) are conveniently provided to facilitate any cleaning which might be deemed desirable.

With reference now to FIG. 1, it will be appreciated that as the printing head 20 moves along its reciprocating path, the suction head 36 during operation will pass from the imperforate end segment 26 to the perforated intermediate segment 28 to the opposite imperforate end segment 30 of the screen member 16. It is preferred that the suction exerted by the suction head 36 be minimal or non-existent as the suction head 36 passes over the imperforate end segments 26 and 30, so as to avoid distorting or damaging the screen member 16. At the same time, it is preferred that the magnitude of the suction exerted as the suction head 36 passes over the perforated intermediate segment 28 be maintained substantially constant at a value sufficient to recover residual pattern forming medium to the upper surface 18.

Figure 7:
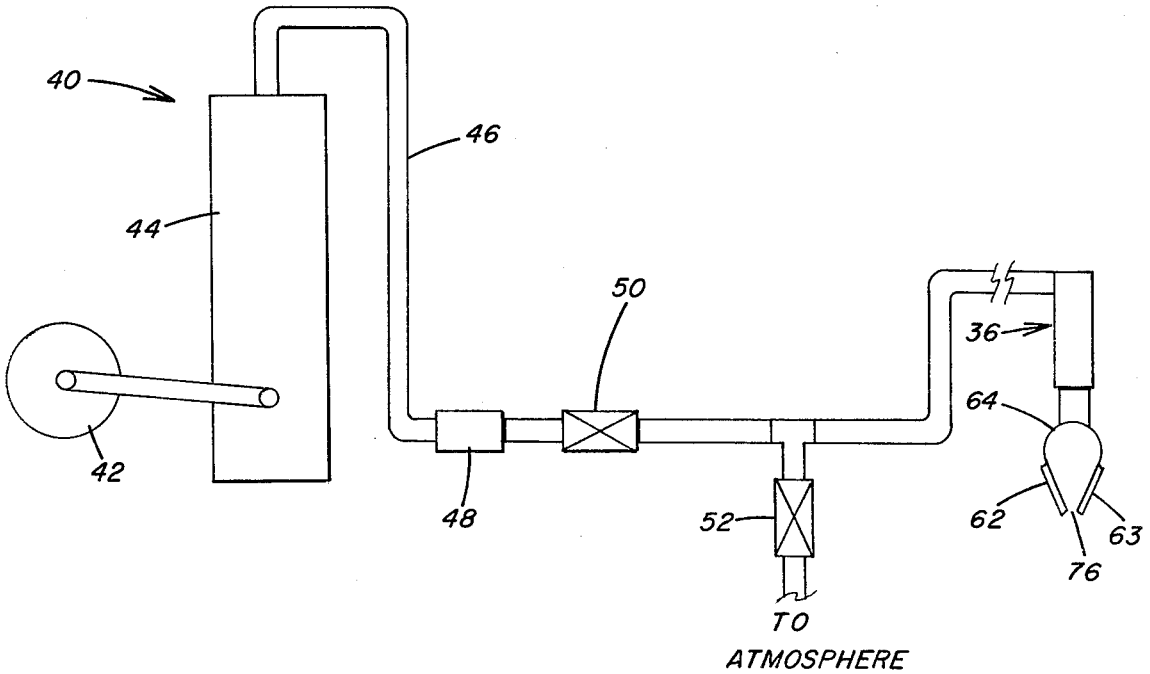
FIG. 7 is a schematic view illustrating a suction control system incorporating features of the present invention.

Referring to FIG. 7, a suction control system 40 is schematically shown including a vacuum pump 42, and a vacuum reservoir 44 which communicate with the suction head 36 through a suction supply line 46, a suction regulator valve 48, a suction shut-off valve 50, and a dump valve 52. In operation, the vacuum pump 42 and the vacuum reservoir 44 serve as a source of suction to the suction head 36. As the suction head 36 is moved into its cleaning position and begins to advance across the imperforate segment end 26 of the screen member 16, the shut-off valve 50 is in a closed position to isolate the suction head 36 from the suction source, and the dump valve 52 is opened to atmosphere to eliminate any suction draw and thereby to avoid distorting or damaging the screen member 16. As the suction head 36 reaches the interface between the imperforate end segment 26 and the intermediate perforated segment 28, the shut-off valve 50 moves to its open position and the dump valve 52 closes. A predetermined suction is thus drawn by the suction head 36 as it proceeds across the intermediate perforated segment 28. As can be appreciated from a study of FIG. 1, the suction head 36 will encounter areas of the intermediate perforated segment 28 which vary in their degree of porosity, e.g., the initial and final regions of the intermediate segment 28 encountered will be largely perforated while regions therebetween will be substantially less perforated. To maintain a substantially constant magnitude of draw by the suction head 36 along its course across the intermediate segment 28, the suction regulator valve 48 is provided in the suction supply line 46. The suction regulator valve 48 may operate on a feedback basis to respond to variations in the degree of porosity encountered by the suction head 36, and preferably is mounted adjacent to the suction head 36 to provide quick response time.

As the suction head 36 advances to the junction of the intermediate segment 28 and the opposite imperforate portion 30, the suction communicated to the suction head 36 from the vacuum reservoir 44 is extinguished by closing the shut-off valve 50. Additionally and substantially simultaneously, the dump valve 52 opens to vent the suction head 36 to atmosphere, to remove any residual suction therein which might grip the imperforate end portion 30 and damage the screen member 16. It is common that the imperforate end portion 30 is elongated and that a reservoir of pattern-forming medium accumulates thereon, making it important to eliminate all residual suction from the suction head 36 before it reaches that point. Accordingly, as shown schematically in FIG. 1, an electrical limit switch 58 is positioned to generate a signal when the printing head 20 arrives at the interface of the central portion 28 and the imperforate end segment 30, which signal may be used to actuate the shut-off valve 50, the dump valve 52, and the air cylinder 74 to raise the head 36 from the surface of the screen 16. The signal may also be used in a preferred practice of the invention to actuate a counter (not shown) which detects the number of printing cycles accomplished and actuates the operation of the suction head 36 after a preselected number thereof. In this manner the suction head 36 may be automatically actuated to intermittently clean the screen member 16 of residual pattern-forming medium. In a preferred practice of the invention, the suction head 36 is actuated into its suctioning position every fifth cycle, i.e., five substrates have patterns applied thereon between each cleaning of the screen member 16.

In one operational embodiment of the suction control system 40, the vacuum pump 42 may be a 5 horsepower (3730 watts), 74 cubic foot per minute (0.035 $m^3/_s$) vacuum pump available from Sihi Pumps Limited of Ontario, Canada as Model LPHE 3408 BN 001.01.0. The vacuum reservoir 44 may be a 200 gallon (757. liters) vertical air receiver available from Binks Mfg. Co. of Canada Ltd. of Toronto, Canada. The regulator valve 48 may be a 2 inch (5 cm.) vacuum regulator valve available from Jordan Valve of Cincinnati, Ohio as a Mark 55. The shut-off valve 50 and the dump valve 52 may each conveniently be ball valves operated by solenoids (not shown). Preferaby, the suction drawn by the suction head 36 during its passage over the intermediate segment will be maintained between about 5 to 10 inches of mercury ($1.7\times10^4$ to $3.4\times10^4$ pascals) i.e., a pressure differential between the top and bottom surfaces of the screen member 16 of about 5–10 inches of mercury ($1.7\times10^4$ to $3.4\times10^4$ pascals) is preferred.

Of course it will be appreciated that the present invention is not intended to be limited by the specific embodiments described herein, but rather, only by the claims.

What is claimed is:

1. A method of applying a pattern upon a substrate comprising the steps of:

practicing a printing cycle including the steps of:

supporting a substrate in a printing position;

positioning a first major surface of a screen member in facing relation to the substrate in the printing position, the screen member having imperforated edge segments about an intermediate at least partially perforated segment, the intermediate perforated segment corresponding to the pattern;

providing a pattern-forming medium on the second and opposite major surface of the screen member;

moving portions of the pattern-forming medium from the second and opposite major surface of the screen member through the perforated segment toward the substrate to form a pattern thereon, wherein residual pattern-forming medium remains in at least localized areas of the perforated segment of the screen member;

spacing the screen member away from the printing position after the practice of said moving step;

removing the substrate having the pattern thereon from the printing position; and repeating the printing cycle; and after a selected printing cycle, practicing the following steps:

advancing a suction applying member across the second and opposite major surface of the screen member over an imperforated edge segment, the intermediate perforated segment and the other imperforated edge segment while the screen member is in the spaced position; and controlling the magnitude of suction of the suction applying member so as to be minimal as the suction applying member advances over the imperforated edge segments to avoid damage thereto and to be greater by a magnitude sufficient to remove the residual pattern-forming medium through the perforated areas as the suction applying member advances over the intermediate perforated segment.

2. The method as set forth in claim 1, wherein the suction applying member passes over areas of varying degrees of porosity as it advances across the intermediate segment of the screen member, and further comprising the step of:

maintaining the suction exerted by the suction applying member at a substantially constant magnitude as the suction applying member passes over the areas of varying degrees of porosity in the intermediate segment of the screen member.

3. The method as set forth in claim 1 wherein the substrate is an automotive vision panel.

4. An apparatus for applying a pattern upon a substrate comprising:

means for supporting a screen member having imperforated edge segments about an intermediate at least partially perforated segment, the intermediate perforated segment corresponding to the pattern;

a printing position for supporting a substrate onto which a pattern is to be applied;

means for moving said supporting means from a first location spaced from said printing position to a second location to mount a first major surface of the screen member to be supported by said supporting means in facing relation to said printing position and the substrate to be supported therein;

means for providing a pattern-forming medium on the second and opposite major surface of the screen member;

means for moving said pattern-forming medium to be provided on the screen member through the perforated segment of the screen member to form a pattern on the substrate wherein residual pattern-forming medium remains in at least localized areas of the perforated segment of the screen member;

a suction applying member;

means for displacing said suction applying member when said screen supporting means and the screen member are in the first location spaced from the printing position over the second and opposite major surface of the screen member, over the imperforated edge segment, the intermediate perforated segment and the other imperforated edge segment of the screen member;

means acting on magnitude of suction applied by said suction applying member as it moves over the screen member under the action of said displacing means so as to be minimal as said suction applying member advances over the imperforated edge segments to avoid damage thereto and to be greater by a magnitude sufficient to remove the residual pattern-forming medium through the perforated areas of the screen member as said suction applying member advances over the intermediate perforated segment.

* * * * *